US008500970B2

(12) United States Patent
Allano et al.

(10) Patent No.: US 8,500,970 B2
(45) Date of Patent: Aug. 6, 2013

(54) ELECTROLYSIS CELL FOR THE PRODUCTION OF ALUMINUM COMPRISING MEANS TO REDUCE THE VOLTAGE DROP

(75) Inventors: Bertrand Allano, Chicoutimi (CA); Delphine Bonnafous, Issoire (FR); Jean Camire, Hamilton South (AU); Martin Desilets, Sherbrooke (CA); Laurent Fiot, Hermillon (FR); Pierre Fournier, Saguenay Jonquiere (CA); Yvon Gauthier, Canton Tremblay (CA); Denis Laroche, Jonquiere (CA); Oliver Martin, Hermillon (FR); Pascal Thibeault, Chitoumini (CA); Serge Bouchard, Chicoutimi (CA)

(73) Assignee: Rio Tinto Alcan International Limited, Montreal, Quebec (CA)

( * ) Notice: Subject to any disclaimer, the term of this patent is extended or adjusted under 35 U.S.C. 154(b) by 1065 days.

(21) Appl. No.: 11/944,007

(22) Filed: Nov. 21, 2007

(65) Prior Publication Data

US 2008/0135417 A1 Jun. 12, 2008

Related U.S. Application Data

(60) Provisional application No. 60/912,825, filed on Apr. 19, 2007.

(30) Foreign Application Priority Data

Nov. 22, 2006 (EP) ..... 06356135

(51) Int. Cl.

| | |
|---|---|
| ***C25C 3/06*** | (2006.01) |
| ***C25C 3/08*** | (2006.01) |
| ***C25C 3/16*** | (2006.01) |

(52) U.S. Cl.

USPC ..... 204/242; 204/243.1; 204/286.1; 204/279; 205/374; 205/337; 205/372

(58) Field of Classification Search

USPC ..... 204/242, 243.1, 286, 279; 205/374, 205/337, 372

See application file for complete search history.

(56) References Cited

U.S. PATENT DOCUMENTS

| | | | |
|---|---|---|---|
| 2,846,388 | A | 8/1958 | Morel |
| 3,551,319 | A | 12/1970 | Eilliott |
| 3,728,243 | A | 4/1973 | Hatting |
| 4,647,356 | A | 3/1987 | Leroy |

(Continued)

FOREIGN PATENT DOCUMENTS

| | | | |
|---|---|---|---|
| CA | 2258815 | A1 | 7/1999 |
| CA | 2347858 | A1 | 4/2001 |

(Continued)

OTHER PUBLICATIONS

International Search Report from PCT/IB2007/004297 mailed Jul. 16, 2008, 2 pages.

*Primary Examiner* — Harry D Wilkins, III
*Assistant Examiner* — Zulmariam Mendez
(74) *Attorney, Agent, or Firm* — Banner & Witcoff, Ltd.

(57) ABSTRACT

An electrolytic cell is suitable for production of aluminium, and includes at least one collector bar made of first metal and at least one complementary bar made of a second metal having an electrical conductivity greater than the first metal and arranged adjacent to one of the side faces of the collector bar so that the external end of the complementary bar is at a specified distance from a specified end face of the block. The second end terminates so as to limit heat losses from said cell. The cell makes it possible to obtain significantly lower voltage drops while avoiding excessive heat losses through the collector bars.

26 Claims, 9 Drawing Sheets

U.S. PATENT DOCUMENTS

| | | | |
|---|---|---|---|
| 5,976,333 | A | 11/1999 | Pate |
| 6,231,745 | B1 | 5/2001 | Homley et al. |
| 6,387,237 | B1 | 5/2002 | Homley et al. |

FOREIGN PATENT DOCUMENTS

| | | | |
|---|---|---|---|
| CA | 2457363 | A1 | 2/2003 |
| FR | 1161632 | | 9/1958 |
| RU | 2175689 | | 11/2001 |
| SU | 1260412 | A1 | 12/1984 |
| WO | 01/27353 | A1 | 4/2001 |
| WO | 01/63014 | A1 | 8/2001 |
| WO | 02/42525 | A1 | 5/2002 |
| WO | 2004/031452 | A1 | 4/2004 |
| WO | 2005/098093 | A2 | 10/2005 |

ELECTROLYSIS CELL FOR THE PRODUCTION OF ALUMINUM COMPRISING MEANS TO REDUCE THE VOLTAGE DROP

CROSS-REFERENCE TO RELATED APPLICATIONS

The present application claims priority to European Patent Application No. 06356135.1, filed Nov. 22, 2006, and U.S. Provisional Patent Application Ser. No. 60/912,825, filed Apr. 19, 2007, both of which are incorporated herein by reference and made part hereof.

FIELD OF THE INVENTION

The invention relates to the production of aluminium by igneous electrolysis and, more particularly, to electrolysis cells intended for the production of aluminium.

BACKGROUND

Aluminium is produced by electrolytic reduction of alumina dissolved in an electrolyte. Reduction results from the circulation of electrical current between one or more anodes and a cathode arranged in an electrolytic cell. Nowadays, Hall-Héroult aluminium reduction cells are operated at high current intensities often exceeding several hundred thousand amps.

Aluminium producers aim at increasing the current efficiency of the electrolysis cells and at decreasing the specific energy consumption of the same so as to reduce the operating costs of the aluminium reduction plants. The specific energy consumption of a cell, which is usually expressed in kWh/t, is equal to the energy consumed by a cell to produce one tonne of aluminium.

For that purpose, the aluminium producers seek ways to reduce the various electrical voltage drops that develop across an electrolytic cell and make the current distribution more uniform within the cell. Several patents have focused on a reduction in the cathode voltage drop Uc while often aiming at making the current flow more uniform over the surface of the cathodes. In particular, it is known that the cathode voltage drop Uc can be reduced by using composite collector bars including a steel part and a part made of a metal with an electrical conductivity higher than steel, usually copper.

French patent application No. FR 1 161 632 and U.S. Pat. No. 2,846,388 (Pechiney) describe electrolysis cells comprising copper plates that are adjacent the sides of the collector bars and extend all the way to the external end of the bars. Such arrangements are conducive to high thermal losses from the cells owing to the close proximity between the copper plate(s) and the aluminium busbars connected thereto.

U.S. Pat. No. 3,551,319 (Kaiser) describes an electrolysis cell comprising collector bars with a groove on their lower side and a copper conductor inserted within the grooves. U.S. Pat. No. 5,976,333 (Pate) describes arrangements wherein a copper conductor is inserted within a tubular collector bar. In both cases, the copper conductors are directly connected to the busbars. Such arrangements are also conducive to high thermal losses from the cell.

International application WO 02/42525 (Servico) describes arrangements wherein the copper conductor is encapsulated within the collector bar. International applications WO 01/63014 (Comalco) and WO 01/27353 (Alcoa) describe arrangements wherein copper conductors are inserted within the collector bars and separated from the connection means by a steel spacer in order to reduce the thermal losses of the cell. International patent application WO 2004/031452 (Alcan) and International patent application WO 2005/098093 (Aluminium Pechiney) describe arrangements comprising a copper insert and a varying sealing area between the collector bar and the carbonaceous block in order to improve the current distribution along the block. However, arrangements comprising inserts are quite difficult and expensive to make. Moreover, such designs make it difficult to significantly decrease the size of the collector bars.

Therefore the applicant addressed the issue of finding industrially acceptable solutions to the drawbacks of prior art, and particularly to the problem of specific energy consumption.

BRIEF SUMMARY

Aspects of the invention relate to an electrolytic cell intended for production of aluminium that includes:

- A metallic shell comprising two lateral walls that are arranged substantially symmetrically with respect to a central plane,
- At least one carbonaceous cathode block having side faces, end faces and at least one groove in one of its side faces, said block being arranged within said shell so that said groove is substantially perpendicular to said central plane,
- At least one collector bar made of first metal having at least one connection end and side faces, and arranged in said groove so that said at least one connection end projects out of said block through a specified end face and out of said shell through a specified lateral wall so as to enable electrical connection to an external electrical circuit, and
- Electrically conducting sealing material within said groove to provide electrical contact between said collector bar and said block, wherein said cell further includes at least one complementary bar made of a second metal having an electrical conductivity greater than said first metal, wherein said at least one complementary bar has a first end and a second end, has a specified length and is arranged adjacent to one of said side faces of said collector bar, and wherein said second end is at a specified distance from said specified end face of said block and terminates so as to limit heat losses from said cell.

In one possible embodiment, heat losses are reduced by arranging said complementary bar so that said second end is shifted from said connection end by a shift distance. In another possible embodiment, heat losses are reduced by varying the cross-section of said complementary bar along said complementary bar, preferably in the vicinity of said second end, so as to impart thermal resistance to said complementary bar towards said connection end. Said embodiments for the termination of said second end may be combined.

In another embodiment, said collector bar and said complementary bar are electrically insulated from said block in at least one area extending between said specified end face of said block and a reference plane that is parallel to said central plane and is located at a lateral distance from said specified end face toward said central plane. The insulated area so obtained significantly reduces the current density in the vicinity of said specified end face of said block and makes it possible to avoid the formation of a large peak in the longitudinal profile of said current density. Said electrical insulation is typically obtained by providing a gap between said collector bar and said cathode block and between said complementary bar and said cathode block in said area. This gap is preferably devoid of electrically conducting sealing material.

According to one aspect, the first metal is a ferrous metal, and is typically steel. According to another aspect, the second metal is typically copper or a copper alloy.

According to another aspect, the invention makes it possible to obtain significantly lower voltage drops than known cells while avoiding excessive heat losses through the collector bars.

According to another aspect, the ratio of the transverse vertical cross-section of said at least one complementary bar to the transverse vertical cross-section of said collector bar is greater than 5:100 so as to substantially reduce the voltage drop through a cell. Said transverse vertical cross-sections refer to cross-sections in a substantially vertical direction within said cell and substantially parallel to said central plane S.

According to a further aspect, the overall transverse vertical cross-section of a composite collector bar arrangement according to the invention, i.e., an arrangement including said collector bar and at least one complementary bar according to the invention, could be made significantly smaller than the transverse vertical cross-section of a single collector bar according to prior art without increasing the voltage drop of the cell including such a composite collector bar arrangement. According to this aspect, values of said ratio that are larger than 25:100 can impart substantial reduction of the room needed for a composite collector bar arrangement according to the invention.

Consequently, aspects of the invention make it possible to significantly increase the thickness G of cathode carbonaceous material above a collector bar, so as to substantially increase the possible lifetime of a cell under normal conditions, and to possibly also reduce the full thickness E of a block, thus saving construction material, without increasing the voltage drop of a cell. In other words, aspects of the invention make it possible to partly or totally convert the reduction of the room usually needed for a collector bar into a reduction of the total block height with the corresponding costs savings associated thereto.

Other aspects of the invention relate to a process of producing aluminium by igneous electrolysis, which includes:

Providing an electrolysis cell according to the first aspect of the invention, said cell further comprising at least one anode, and Passing an electric current between said at least one anode and said carbonaceous cathode block, so as to produce aluminium by electrolytic reduction of alumina.

DESCRIPTION OF THE DRAWINGS

The invention is described in more detail below, by way of examples, with reference to the accompanying drawings wherein.

DETAILED DESCRIPTION

Figure 1:
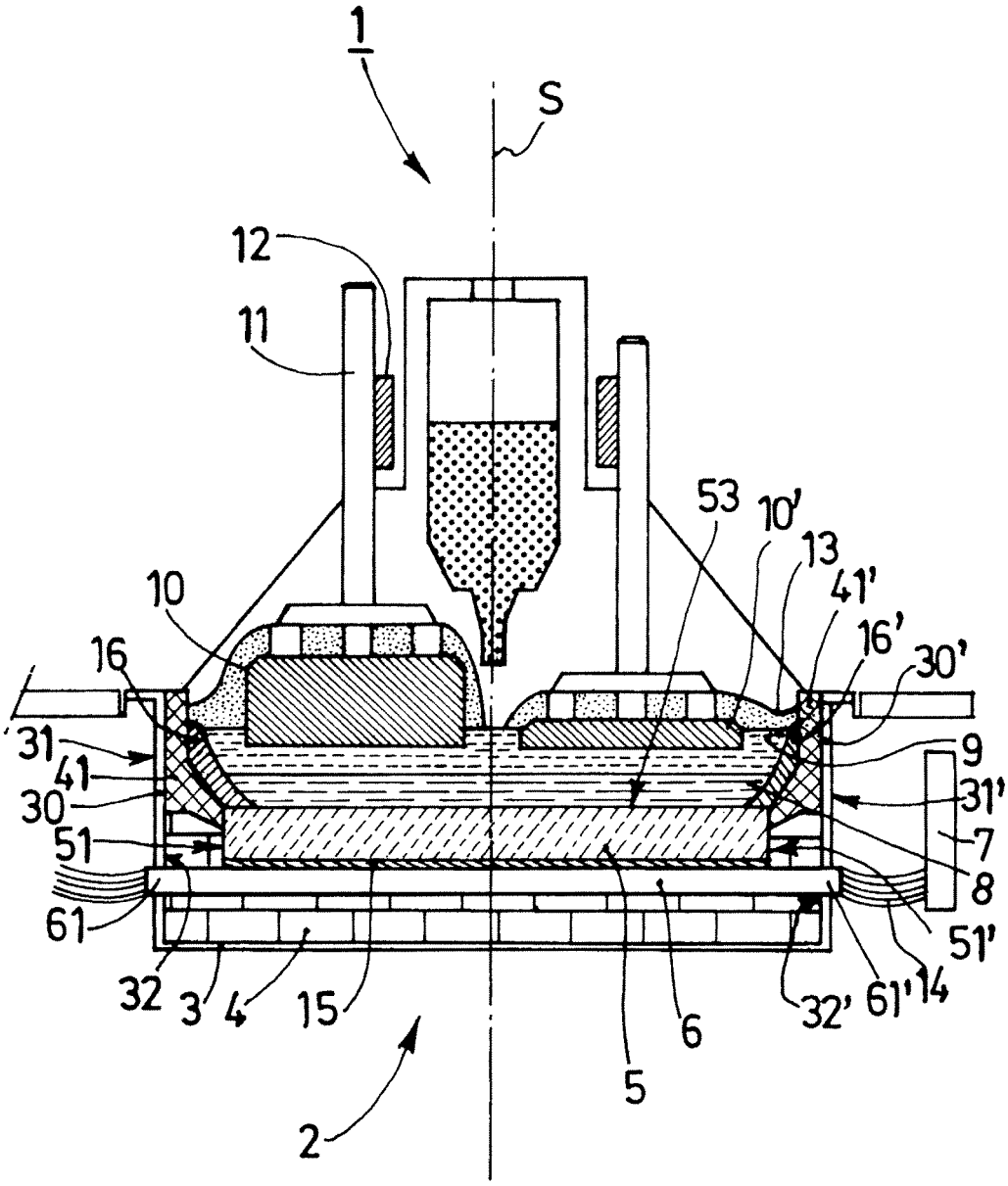
FIG. 1 shows a transverse cross-sectional view of a typical electrolysis cell.

As illustrated in FIG. 1, an electrolysis cell 1 designed for the production of aluminium typically comprises a pot 2 that includes a metallic shell 3 lined with refractory material 4, 41, 41' that includes side linings 41, 41'. Said pot 2 typically further includes at least one carbonaceous cathode block 5 that is connected to at least one external busbar conductor 7 using at least one cathode collector bar 6, 6' made of an electrically conducting material, typically a ferrous metal such as steel. An electrolytic pot 2 typically includes between about 10 and 30 cathode blocks 5 arranged side by side within said shell 3.

An electrolysis cell 1 further includes one anode or a plurality of anodes 10, 10', depending on the type of cell. Said anodes are typically made of a carbonaceous material that can be baked in the cell during the electrolysis process or prebaked in furnaces. A cell may also include non-consumable or inert anodes.

The type of cell illustrated in FIG. 1 includes a plurality of prebaked anodes 10, 10' that are connected to external electrical conductors using anode stems 11, 11' sealed in said anodes and secured to common conductors 12, 12', called anode beams, using removable connectors (not shown).

In operation, a pot 2 contains a pad 8 of liquid aluminium and a layer of electrolytic bath 9 that includes molten cryolite and alumina dissolved therein. Said anodes 10, 10' are partially immersed in said electrolytic bath 9 and are protected from oxidation by a protecting layer 13 that is mostly comprised of alumina and crushed bath. A solidified bath ridge 16, 16' usually forms on said side linings 41, 41'.

Reduction results from the circulation of electrical current between said anodes 10, 10' and said carbonaceous cathode blocs 5. The current intensities of electrolysis cells depend on their type and size; for the so-called AP30-type cells developed by Aluminium Pechiney the intensity often exceeds 300 kA.

The voltage drop Uc that develops in operation between a pad of liquid aluminium 8 and a connection end 61, 61' of collector bars 6, 6' is typically between 300 to 500 mV. The total voltage drop of an electrolysis cell is typically about 4 to 5 volts.

As seen from above, said metallic shell 3 is generally substantially rectangular, with two lateral walls 30, 30' that are arranged symmetrically with respect to a central plane S that is located midway between said walls and two end walls (not shown). Said lateral walls 30, 30' are parallel to each other and substantially mirror images of each other with respect to said central plane S. Said lateral walls 30, 30' are typically 6 to 21 meters long and said end walls are typically 2 to 4 meters long. Said metallic shell 3 is typically made of steel. Said lateral walls 30, 30' have an outer surface 31, 31' and an inner surface 32, 32'.

Said cathode blocks 5 are typically made of anthracite (amorphous carbon), carbonaceous material containing graphite or graphitised carbon. The graphite-containing cathode blocks are typically either the so-called "semi-graphite" blocks that typically contain between 30 wt. % and 50 wt. % of graphite or the so-called "graphite" blocks that contain essentially 100 wt. % of graphite grains and a binder that remains amorphous. The blocks containing graphitised carbon are usually referred to as "graphitised" blocks. A high temperature graphitisation heat treatment is carried out on these blocks, increasing the electrical conductivity of the block by graphitisation of the amorphous carbon. The blocks containing graphite or graphitised carbon are preferred to blocks made of anthracite because of the low electrical resistance of the former compared to the latter reduces the voltage drop across the cathode blocks. Said cathode blocks 5 are more preferably graphitised blocks.

Said cathode blocks 5 and said collector bar 6, 6' form cathode assemblies 50 that are usually assembled outside a pot 2 and are added to a shell 3 during the formation of its inner lining.

Said collector bar 6, 6' has ends 61, 61', 62, 62' and side faces 63, 64, 65, 66 between said ends.

Said collector bar 6, 6' typically has round, square or rectangular cross-sections. The invention is further described below, with reference to the appended figures, using illustrative embodiments comprising bars with rectangular or square cross-sections. The invention can be embodied using bars with round cross-sections.

Figure 2:
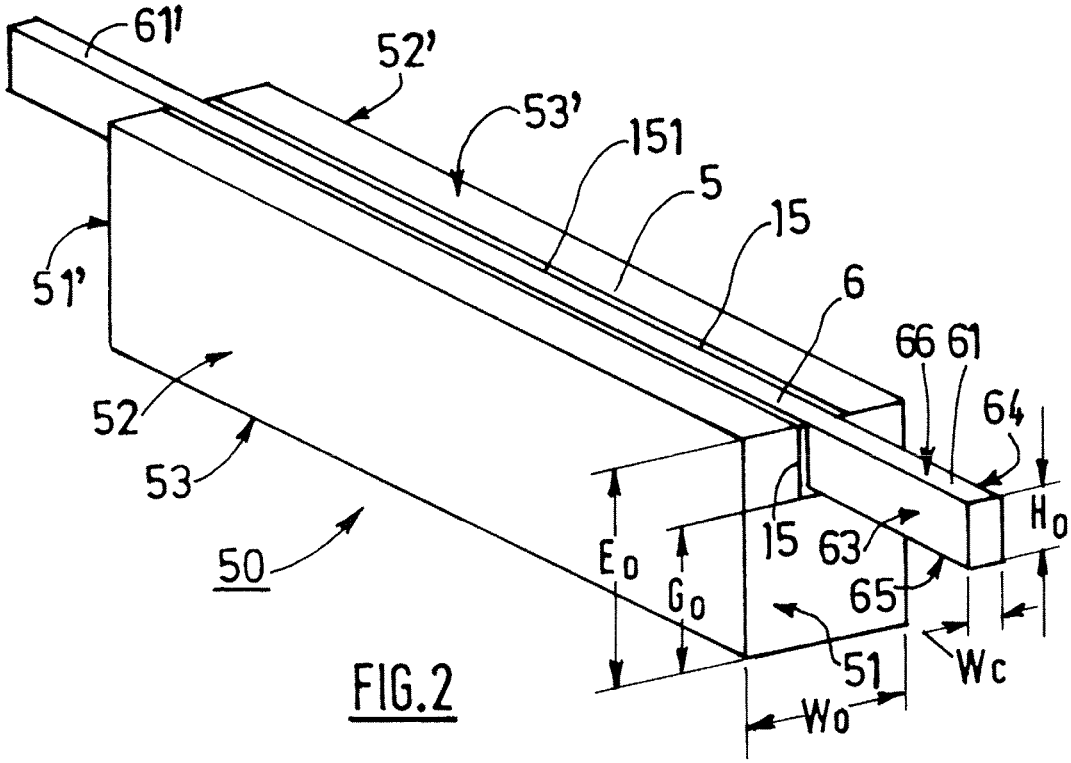
FIG. 2 shows a possible cathode assembly according to the prior art.
Figure 3:
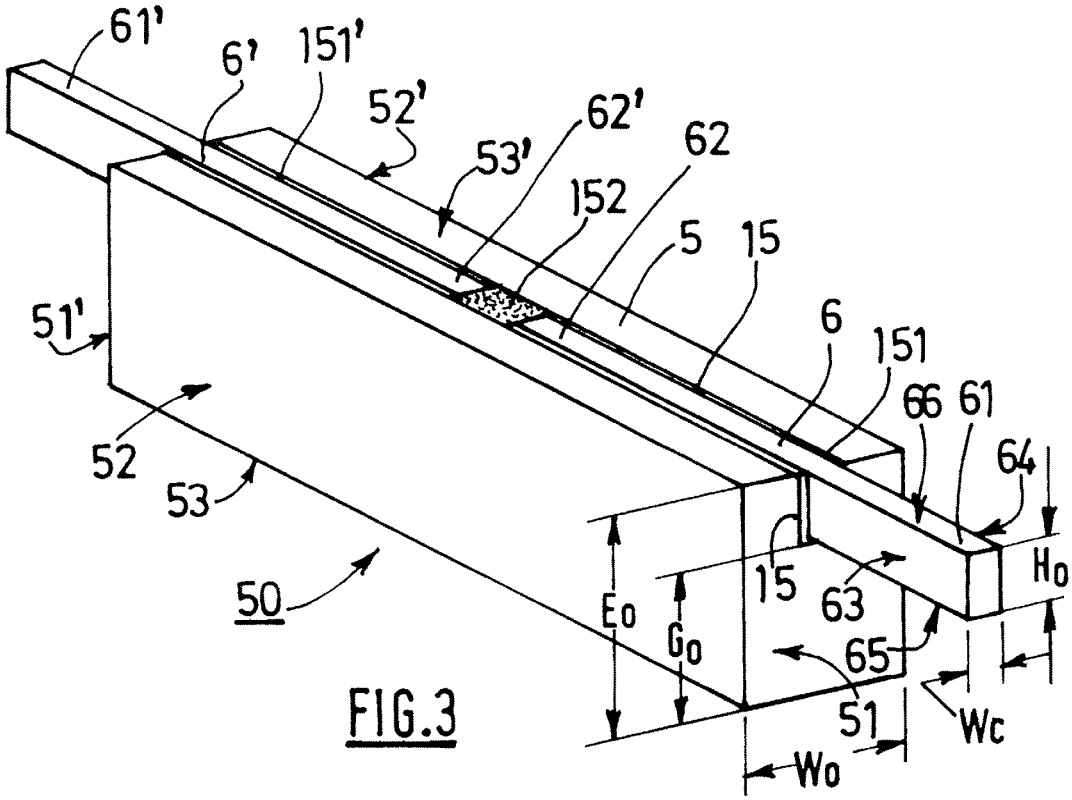
FIG. 3 shows another possible cathode assembly according to the prior art.

A cathode assembly 50 may include one or several "full-length" collector bars 6 that pass through said block 5 from one end to the other, as illustrated in FIG. 2, or one or several pairs of "half-length" collector bars 6, 6', called half-bars, typically in line, that extend only over a part of said block 5, as illustrated in FIG. 3. In the latter case, the half-bars are often separated by a gap 152 that is typically filled with refractory, electrically insulating material, such as non-ceramic fibres, or carbon paste or blocks.

As illustrated in FIGS. 2 and 3, said cathode block 5 is substantially parallelepiped in shape and has a first end face 51, a second end face 51', and side faces 52, 52', 53, 53'. Said cathode block 5 has a width Wo and a full thickness E. When arranged in an electrolytic pot 2, said end faces 51, 51' and side faces 52, 52' are substantially vertical, while side faces 53, 53' are substantially horizontal, side face 53 being an upper face and side face 53' being a lower face.

Said lower side face 53' includes at least one longitudinal groove 15 that open up at said end faces 51, 51' and usually extends all the way from said first end face 51 to said second end face 51'. Said groove 15 typically faces downwards in a cell 1.

Said cathode block 5 is usually arranged within the shell 3 so that said groove 15 is substantially perpendicular to said central plane S and so that said end faces 51, 51' are at a determined distance from an inner surface 32, 32' of the corresponding lateral walls 30, 30', as illustrated in FIG. 1. When applicable, said determined distance is typically substantially the same for all blocks 5 and for all end faces 51, 51'.

At least one collector bar 6, 6' is sealed within said groove 15 using electrically conducting sealing material 151, 151' that provides low resistance electrical contact between said collector bar 6, 6' and said block 5. Said electrically conducting sealing material 151, 151' is typically cast iron, conducting glue or a conducting paste such as carbonaceous paste.

FIG. 2 illustrates a possible cathode assembly 50 with a single groove 15 and one collector bar 6 that is longer than the block 5. In such an embodiment, a first connection end 61 of the collector bar 6 projects out of a first end face 51 of said block 5 and a second connection end 61' of the collector bar 6 projects out of a second end face 51' of said block 5.

FIG. 3 illustrates another possible cathode assembly 50 with a single groove 15 and a pair of collector bars 6, 6' that are shorter than the block 5. In such an embodiment, a connection end 61 of a first collector bar 6 projects out of a first end face 51 of the block 5 while an inner end 62 is located inside said groove 15 and a connection end 61' of a second collector bar 6' projects out of a second end face 51' of the block 5 while an inner end 62' is located inside said groove 15.

As illustrated in FIG. 1, said collector bar 6, 6' passes through said lateral walls 30, 30' of said shell 3 for connection to an external electric circuit, typically to one or more busbar conductors 7, usually made of aluminium. Electrical connection to external busbar conductors 7 is typically done using flexible aluminium fittings 14 soldered and/or bolted to at least one connection end 61, 61' of said collector bar 6, 6' that juts out of said lateral walls 30, 30' of said shell 3. Said collector bar 6, 6' collects the current that passes through a cathode block 5 and direct it to a conductor network located outside said pot.

According to one embodiment, said cell 1 further includes at least one complementary bar 20, 20', 21, 21', 21' made of a second metal that has an electrical conductivity greater than that of said collector bars 6, 6', preferably at all temperatures between room temperature and about 1000° C.

The electrical conductivity of ferrous metals such as steel is typically about $10^7$ S/m at room temperature (20° C.) and about $9\times10^5$ S/m at 1000° C. Hence, the electrical conductivity of said complementary bar 20, 20', 21, 21' is preferably substantially greater than about $10^7$ S/m at room temperature and greater then $10^6$ S/m at 1000° C. Said complementary bar 20, 20', 21, 21' is preferably made of a metal selected from copper and copper alloys because these metals have high conductivity and high melting temperatures. Said copper alloys typically include more than 90 wt. % copper, and preferably more than 95 wt. % copper. The electrical conductivity of copper is about $6.3\times10^7$ S/m at room temperature and about $1.2\times10^7$ S/m at 1000° C. These values for the electrical conductivity correspond to an electrical resistivity equal to about $1.7\times10^{-8}$ Ω·m at room and about $8.5\times10^{-8}$ Ω·m at 1000° C.

Said complementary bar 20, 20', 21, 21' is typically elongated and arranged substantially longitudinally along a collector bar 6, 6'. More precisely, said complementary bar 20, 20', 21, 21' has a first end 201, 201', 211, 211' and a second end 202, 202', 212, 212', has a specified length L and is arranged adjacent to one of said side faces 63, 64, 65, 66 of a collector bar 6, 6'. Preferably, said complementary bar 20, 20', 21, 21' is arranged so that said second end 202, 202', 212, 212' of said complementary bar 20, 20', 21, 21' is located at a specified distance A, A' from a first end face 51 of said block 5. Said specified distance A, A' is typically between −150 mm and +600 mm, where the negative sign means that said second end 202, 202', 212, 212' is within said block 5, while the positive sign means that said second end 202, 202', 212, 212' is outside said block 5.

According to one embodiment, said collector bar 6, 6' and said complementary bar 20, 20', 21, 21' are preferably electrically insulated from said block 5 in an area 150, 150' that extends between an end face 51, 51' and a reference plane P, P' parallel to said central plane S and located at a lateral distance B, B' from said end face 51, 51' toward said central plane S. Electrical insulation is preferably obtained by providing a gap between said collector bar 6, 6' and said cathode block 5 and between said complementary bar 20, 20', 21, 21' and said cathode block 5 in said area. Said lateral distance B, B' is typically between 20 and 500 mm. Said gap is preferably devoid of electrically conducting sealing material 151, 151'. Said gap in said insulated areas 150, 150' may contain refractory insulating materials, such as non-ceramic fibres.

Said complementary bars 20, 20', 21, 21' may be adjacent a top side face 65 of said collector bar 6, 6', i.e., adjacent a side 65 of said collector bar 6, 6' facing a bottom inner side 155 of a groove 15, and/or adjacent at least one of lateral side faces 63, 64 of said collector bar 6, 6', i.e., at least one of the side faces 63, 64 of a collector bar 6, 6' facing lateral inner sides 153, 154 of a groove 15.

In one embodiment, said first end 201, 201', 211, 211' of said complementary bar 20, 20', 21, 21' is recessed from said central plane S by a recess distance C, C'. Said recess distance C, C' is typically between 20 and 1300 mm. This embodiment provides a useful adjustment parameter for optimizing the amount of copper needed with respect to the impact of said complementary bar 20, 20', 21, 21' on the voltage drop. This embodiment further makes it possible to reduce the impact of the thermal expansion of said complementary bar in operation. This embodiment is typically embodied by providing complementary bars 20, 20', 21, 21' on each side of said central plane S, which may be arranged symmetrically or asymmetrically with respect to said central plane S. FIGS. 4 to 11 illustrate various examples of possible embodiments with such features.

As illustrated in FIGS. 4 to 11, a cell according to the invention may include at least one complementary bar 20, 20', 21, 21' on each side of said central plane S, typically a plurality of complementary bars 20, 20', 21, 21'. Said complementary bar 20, 20', 21, 21' typically has a rectangular transverse cross-section. Said rectangular transverse cross-section may be uniform all over said specified length L, L' of said complementary bar 20, 20', 21, 21' or be non-uniform.

As illustrated in FIGS. 4 to 11, a first end 201, 201', 211, 211' of said complementary bar 20, 20', 21, 21' is preferably located within a groove 15 of said block 5 and preferably between a collector bar 6, 6' and said block 5, so as to more easily protect said complementary bar 20, 20', 21, 21' with said sealing material 151, 151', while a second end 202, 202', 212, 212' of said complementary bar 20, 20', 21, 21' preferably projects out of an end face 51, 51' of said block 5.

Advantageously, said collector bar 6, 6' has a rectangular cross-section and at least a part of said complementary bar 20, 20', 21, 21' has a rectangular cross-section, as illustrated in FIGS. 4 to 11. These shapes can make it easier to assemble a cathode assembly 50.

The thickness T of said complementary bar 20, 20', 21, 21' is advantageously uniform over its specified length L, L', as illustrated in FIGS. 4 to 11. This can make it easier to fabricate said complementary bar 20, 20', 21, 21' in large numbers. When a block 5 includes one or more complementary bars 20, 20', 21, 21' at each of its ends 51, 51', their specified lengths L, L' are typically equal.

Figure 4:
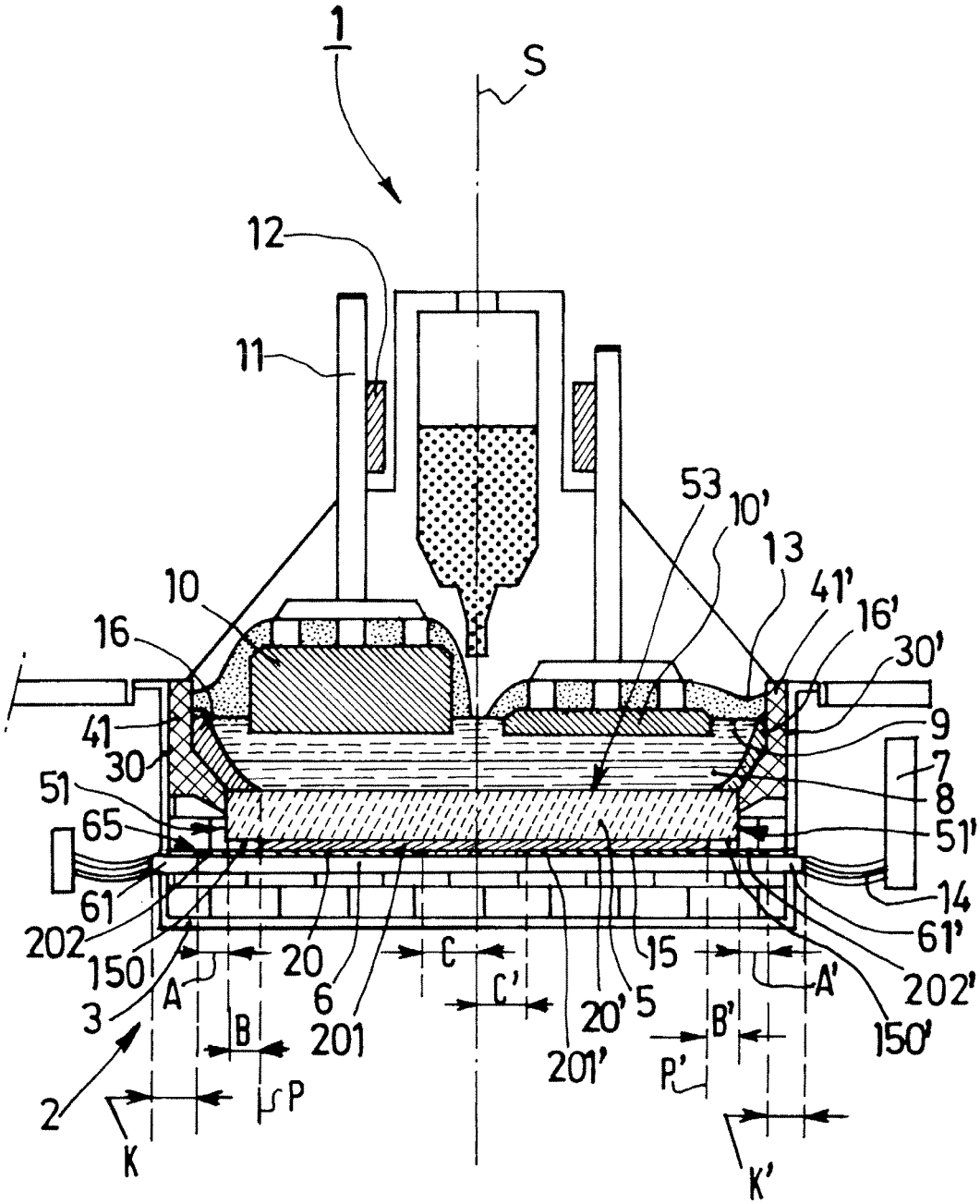
FIG. 4 shows a transverse cross-sectional view of one embodiment of an electrolysis cell.

In the embodiment shown in FIG. 4, said cell 1 includes a plurality of carbonaceous cathode blocks 5 and at least one "full-length" collector bar 6 in each cathode block 5, a first complementary bar 20 on one side of said central plane S and a second complementary bar 20' on an opposite side of said central plane S. A first connection end 61 and a second connection end 61' of said collector bar 6 jut out of a first end face 51 and a second end face 51' of said block 5, respectively, and protrude through a first lateral wall 30 and a second lateral wall 30' of said shell 3, respectively, for electrical connection thereto. Said complementary bar 20, 20' is adjacent a upper side face 65 of said collector bar 6, that is a side face 65 of said collector bar 6 that faces a bottom surface 155 of a groove 15.

Said first and second connection ends 61, 61' of said collector bar 6 may be electrically connected to at least one external busbar conductor 7.

For each collector bar 6, said first end 201 of said first complementary bar 20 is located within said shell 3 at a first recess distance C from said central plane S, towards a first end face 51 of said block 5, while said second end 202 of said first complementary bar 20 is located at a first specified distance A from a first end face 51 of said block 5 (which is a first jutting distance A in the case illustrated in FIG. 4). Said first end 201' of said second complementary bar 20' is located within said shell 3 at a second recess distance C' from said central plane S, towards a second end face 51' of said block 5, while said second end 202' of said second complementary bar 20' is located at a second specified distance A' from a second end face 51' of said block 5 (which is a second jutting distance A' in the case illustrated in FIG. 4).

Said groove 15 is electrically insulated from said collector bar 6 and said first complementary bar 20 in a first area 150 extending between said first end face 51 of said block 5 and a first plane P parallel to said central plane S and located at a first lateral distance B from said first end face 51 towards the central plane S, so as to electrically insulate said collector bar 6 and said first complementary bar 20 from said block 5 in the first area 150. Said groove 15 is also electrically insulated from said collector bar 6 and said second complementary bar 20' in a second area 150' extending between said second end face 51' of said block 5 and a second plane P parallel to said central plane S and located at a second lateral distance B' from the second end face 51' towards the central plane S, so as to electrically insulate said collector bar 6 and said second complementary bar 20' from said block 5 in said second area 150'.

Figure 5:
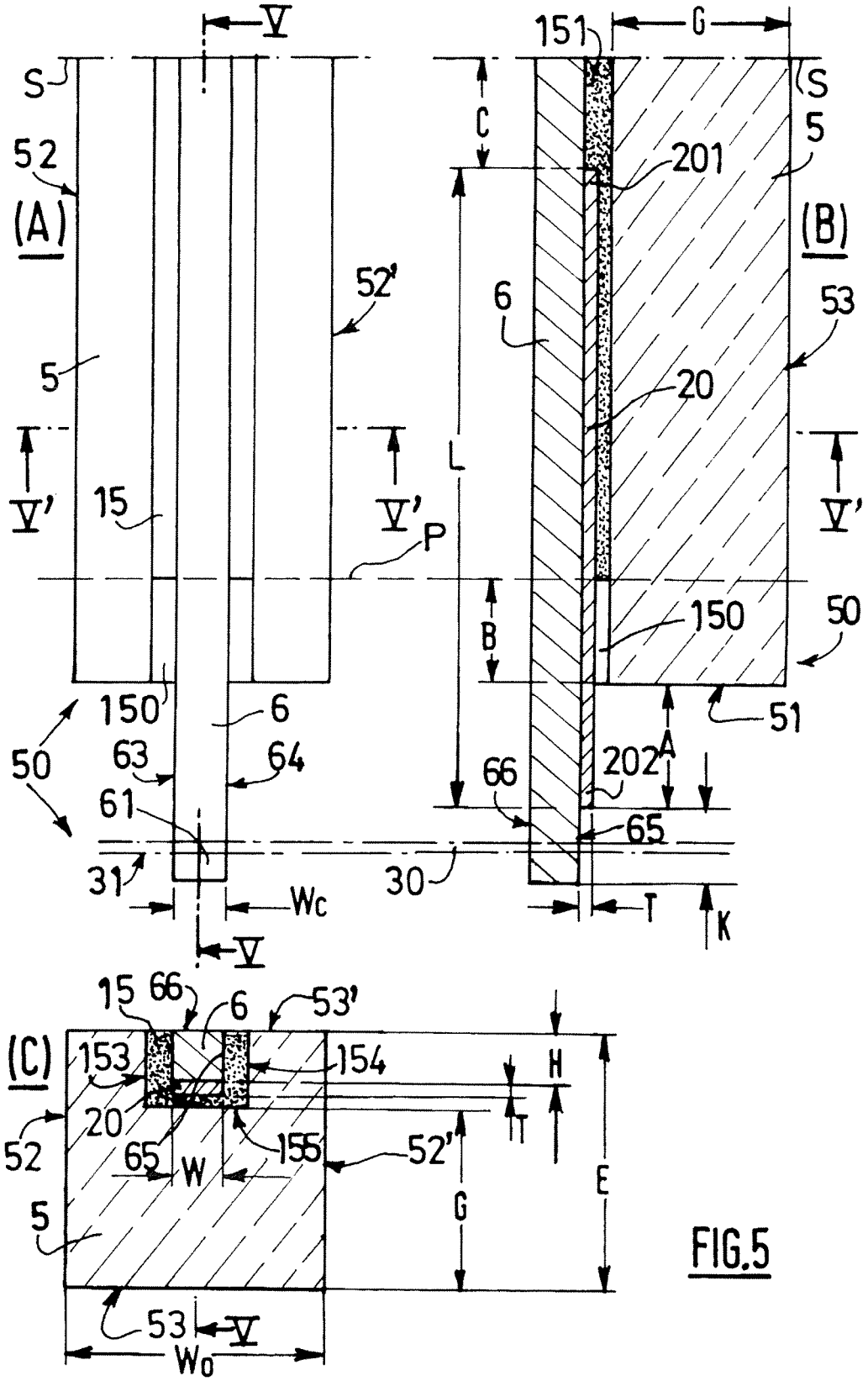
FIG. 5 shows a side view and cross-sectional views of one embodiment of a cathode assembly.
Figure 6:
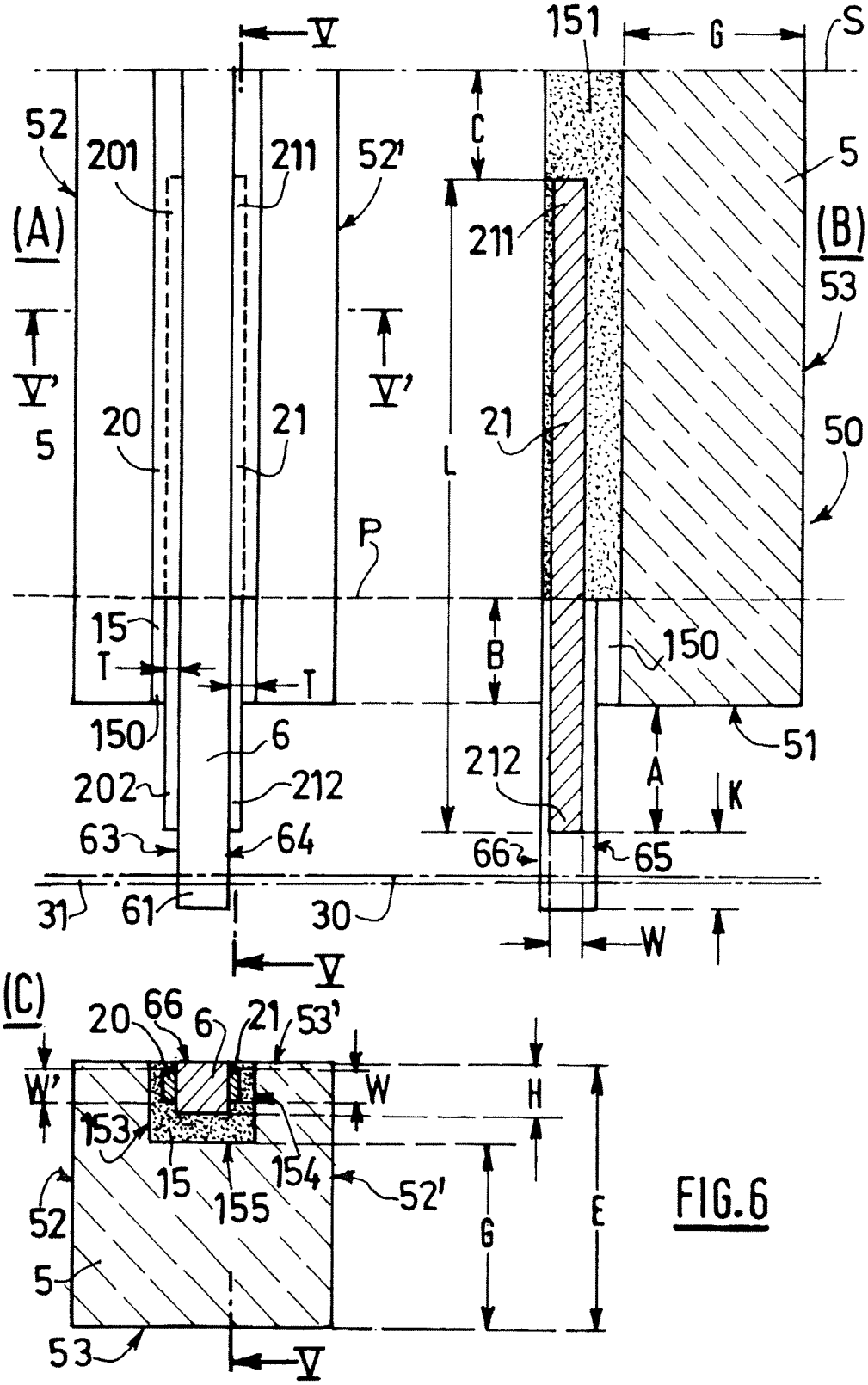
FIG. 6 shows a side view and cross-sectional views of another embodiment of a cathode assembly.

FIGS. 5 and 6 illustrate embodiments of a cathode assembly 50 constituting two variations of the embodiment shown in FIG. 4. For simplicity, these FIGS. 5 and 6 illustrate embodiments of the invention wherein the specified length L of said first complementary bars 20 is equal to the specified length L' of said second complementary bars 20', said first recess distance C is equal to said second recess distance C', said first specified distance A is equal to said second specified distance A' and said first lateral distance B is equal to said second lateral distance B'. These parameters are referred to as specified length L, recess distance C, jutting distance A and lateral distance B, respectively. Furthermore, in order to enlarge the components on the drawing, these figures only show a part of a cathode assembly 50 that is situated on a side of said central plane S where said first lateral wall 30 is located. The dashed line 31 represents an outer surface of said first lateral wall 30 of said shell 3. The arrangement for a part of a cathode assembly 50 that is situated on an opposite side of said central plane S is a mirror image of this arrangement with respect to said central plane S.

In FIGS. 5 and 6, part (A) is a bottom view of a cathode block; part (B) is a longitudinal vertical cross-sectional view of said block in plane V-V; part (C) is a transverse vertical cross-sectional view of said block in plane V'—V'.

In the embodiments illustrated in FIGS. 5 and 6, said block 5 comprises a single groove 15, one collector bar 6 is inserted in said groove 15 and said complementary bars 20, 20' are directly in contact with said collector bar 6.

FIG. 5 illustrates an embodiment wherein a complementary bar 20, 20' is adjacent an upper side face 65 of said collector bars 6, that is a side face 65 of said collector bars 6 facing a bottom surface 155 of said groove 15. The width W of said complementary bar 20, 20' may be substantially identical to the width Wc of said collector bar 6, 6', as illustrated, or differ from said width Wc.

FIG. 6 illustrates an embodiment wherein a cathode assembly 50 includes one collector bar 6 and two complementary bars 20, 21 on opposite lateral side faces 63, 64 of each collector bar 6. In other words, said cathode assembly 50 includes a first complementary bar 20 adjacent a lateral side face 63 of said collector bar 6 and a second complementary bar 21 adjacent an other lateral side face 64 of said collector bar 6.

Said second end 202, 202', 212, 212' of said complementary bar 20, 20', 21, 21' is preferably located within said shell 3, as illustrated in FIGS. 4 to 6, so as to reduce heat losses towards the outside of said shell.

Said second end 202, 202', 212, 212' preferably terminates so as to limit heat losses from said cell 1. This termination may be embodied by shifting said second end 202, 202', 212, 212' from said at least one connection end 61, 61' by a shift distance K, K'. Said shift distance K, K' is preferably greater than 100 mm, and is typically between 100 and 1000 mm. In another embodiment, alternatively, or in combination, this termination may be embodied by varying the cross-section of said complementary 20, 20', 21, 21' along said at least one complementary bar 20, 20', 21, 21' so as to impart thermal resistance to said at least one complementary bar 20, 20', 21, 21' towards said at least one connection end 61, 61'. Such an embodiment is particularly advantageous when said second end 202, 202', 212, 212' of said complementary bar 20, 20', 21, 21' is located outside said shell 3. Said cross-section of said complementary 20, 20', 21, 21' is preferably varied in the vicinity of said second end 202, 202', 212, 212'. For example, said cross-section of said complementary bar 20, 20', 21, 21' may be smaller between a transition plane 22, that is located at an intermediate distance D from said end faces 51, 51' of said block 5 and said second end 202, 202', 212, 212' of said complementary bar 20, 20', 21, 21', than between said first end 201, 201', 211, 211' of said complementary bar 20, 20', 21, 21' and said transition plane 22, said transition plane 22 being typically parallel to said central plane S. Said intermediate distance D is typically between −200 mm and +300 mm, where the minus signs means that said transition plane 22 is within said block 5 while the positive sign means that said transition plane 22 is outside said block 5. Said transition plane 22 is at a specified inward shift distance K2 from said en face 51, 51', which is preferably greater than 100 mm.

Said transition plane 22 is typically inside said shell 3. In other words, said transition plane 22 is located between said end faces 51, 51' of said blocks 5 and said outer surface 31, 31' of said lateral walls 30, 30' of said shell 3.

Figure 7:
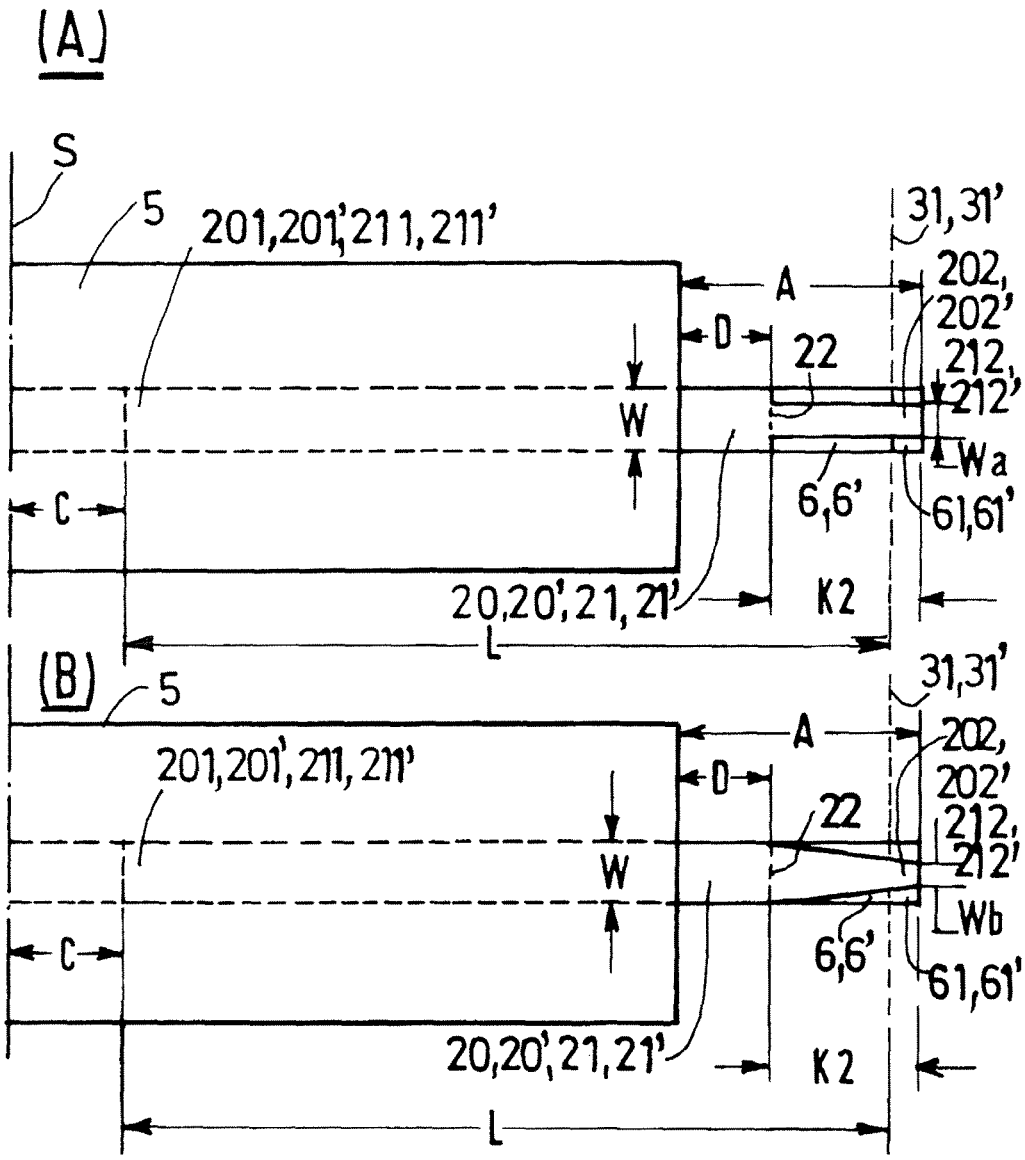
FIG. 7 shows side views of another embodiment of a cathode assembly.

FIG. 7 illustrates various additional embodiments. FIG. 7(A) illustrates an embodiment wherein said complementary bar 20, 20', 21, 21' has a first uniform cross-section between a first end 201, 201', 211, 211' thereof and a transition plane 22 located at an intermediate distance D from said end faces 51, 51' of said block 5 and a second uniform cross-section between said transition plane 22 and a second end 202, 202', 212, 212' thereof. This arrangement can be embodied using a plate with a constant thickness, a first constant width W between said first end 201, 201', 211, 211' and said intermediate distance D and a second width Wa between intermediate distance D and said second end 202, 202', 212, 212'.

FIG. 7(B) illustrates an embodiment wherein said complementary bar 20, 20', 21, 21' has a first uniform cross-section between a first end 201, 201', 211, 211' thereof and a transition plane 22 located at an intermediate distance D from said end faces 51, 51' of said block 5 and a decreasing cross-section between said transition plane 22 and a second end 202, 202', 212, 212' thereof. This arrangement can be embodied using a plate with a constant thickness, a first constant width W between said first end 201, 201', 211, 211' and said transition plane 22 and a decreasing width between said transition plane 22 and said second end 202, 202', 212, 212', ending at width Wb. Said decreasing width is typically linearly decreasing, as illustrated in FIG. 7(B).

Figure 8:
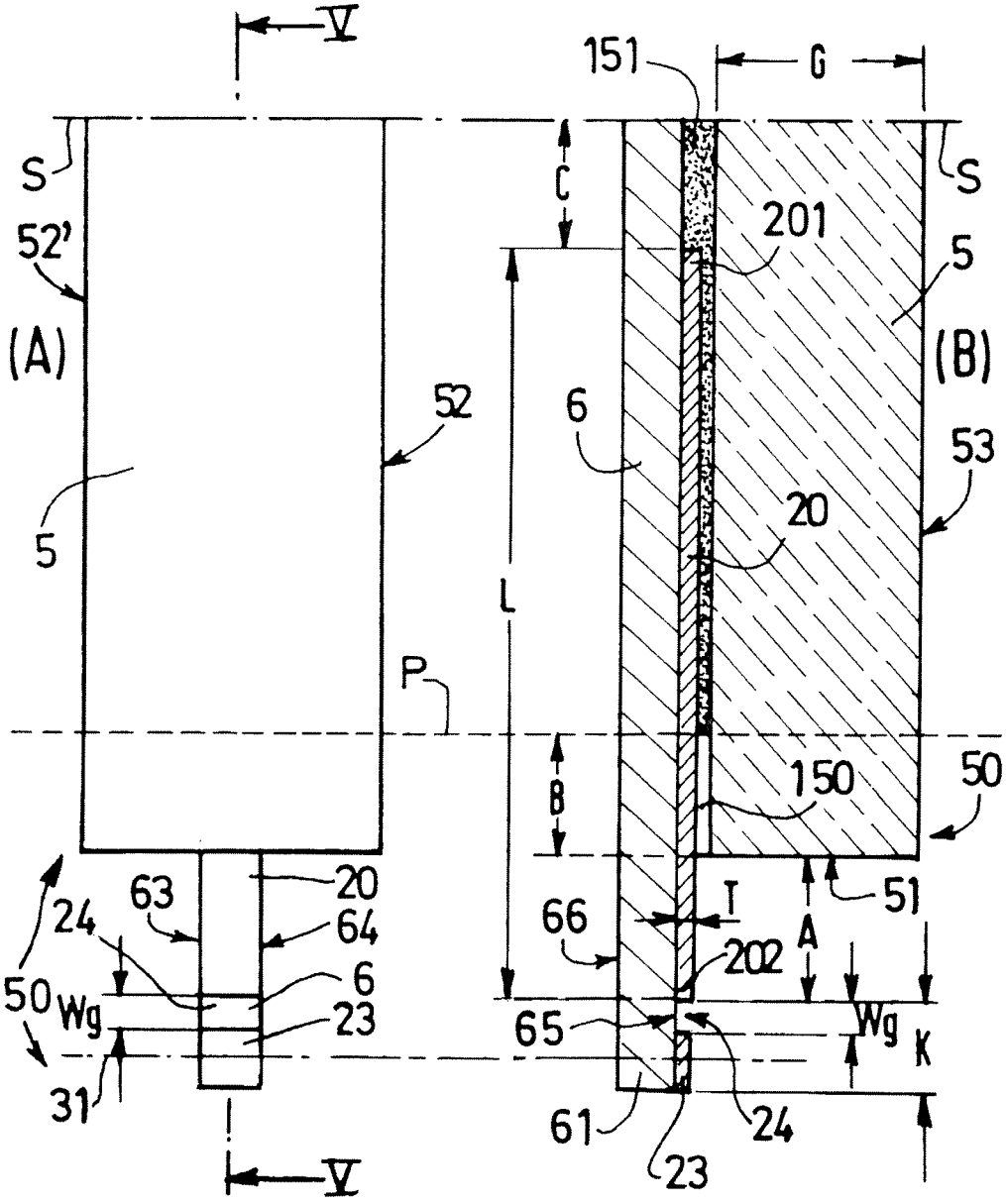
FIG. 8 shows a side view and a cross sectional view of another embodiment of a cathode assembly.

As illustrated in the embodiment of FIG. 8, a supplementary bar 23 made of a third metal may be arranged on a connection end 61, 61' of said collector bar 6, 6' so that there is a gap 24 between said complementary bar 20, 20', 21, 21' and said supplementary bar 23. Said gap 24 enables the voltage drop to be further reduced while maintaining thermal resistance between said complementary bar 20, 20', 21, 21' and said supplementary bar 23. Said third metal, which is typically the same as said second metal, has an electrical conductivity greater than said first metal. The width Wg of said gap 24 is typically between 10 and 1000 mm, and more typically between 20 and 200 mm.

Figure 9:
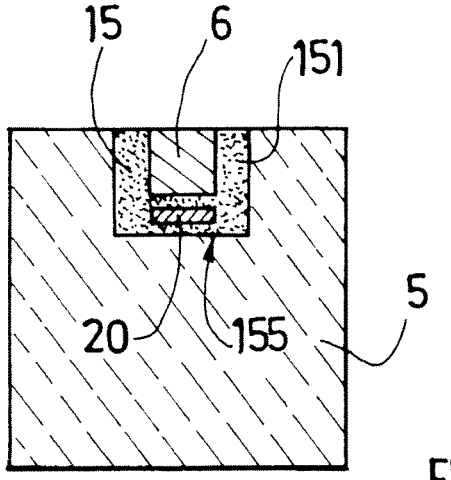
FIG. 9 shows a cross sectional view of another embodiment of a cathode assembly.
Figure 10:
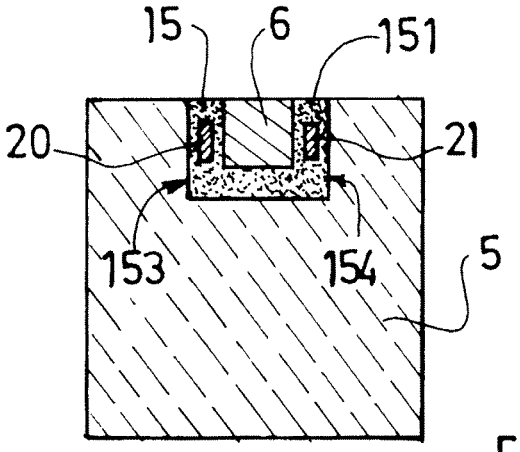
FIG. 10 shows a cross sectional view of another embodiment of a cathode assembly.

Said complementary bar 20, 20', 21, 21' may be directly in contact with said corresponding collector bar 6, 6', as illustrated in FIGS. 5, 6 and 8, or conducting sealing material 151, 151' may be interposed between said collector bars 6, 6' and said complementary bars 20, 20', 21, 21', as illustrated in the embodiments of FIGS. 9 and 10, which are transverse cross-sectional views of cathode assemblies 50 as in part (C) of FIGS. 5, 6 and 8. Conducting sealing material 151, 151' may also surround a part of said complementary bar 20, 20', 21, 21'. FIGS. 9 and 10 show embodiments wherein sealing material 151 is interposed between a collector bar 6 and complementary bars 20, 21 and surrounds a part of said complementary bars 20, 21 that is in sealed areas.

Figure 11:
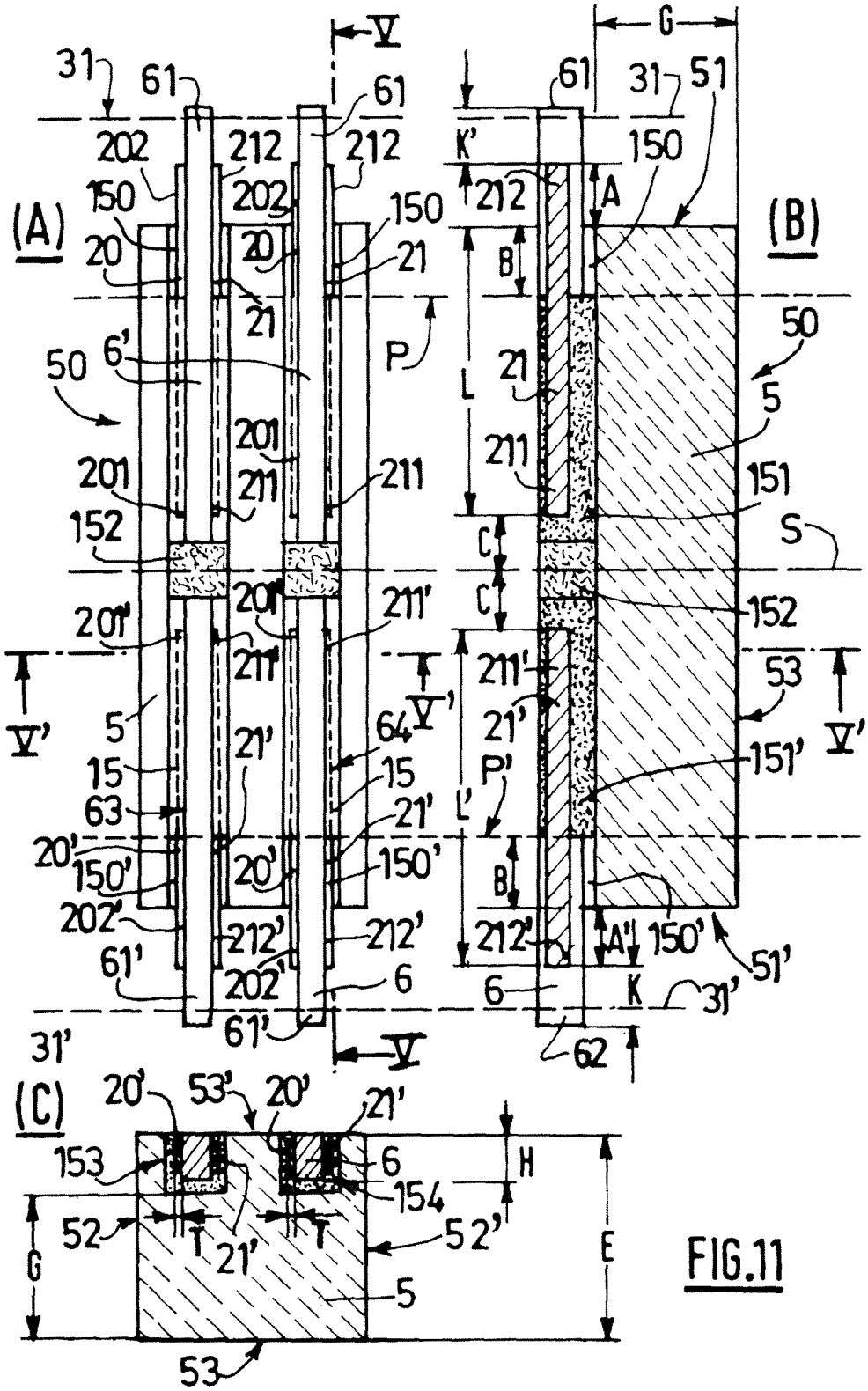
FIG. 11 shows a side view and cross-sectional views of another embodiment of a cathode assembly.

Aspects of the invention can be embodied in cells comprising at least one cathode block 5 including two parallel grooves 15. For illustrative purposes, FIG. 11 shows one embodiment of the invention wherein said block 5 comprises two parallel grooves 15 and a pair of half-length collector bars 6, 6' in each of said groove 15. A first pair of complementary bars 20, 21 is arranged adjacent each first half bar 6 on one side of said central plane S and a second pair of complementary bars 20', 21' is arranged adjacent each second half bar 6' on an opposite side of said central plane S. Said first end 201, 201', 211, 211' of said complementary bars 20, 20', 21, 21' is located within a groove 15 of said block 5 and between a collector bar 6, 6' and lateral inner faces 153, 154 of said block 5, at a recess distance C, C' from the central plane S. Said second end 202, 202', 212, 212' of said complementary bars 20, 20', 21, 21' projects out of an end face 51, 51' of said block 5 to a specified distance A, A'. A gap is formed in an area 150, 150' of width B, B' adjacent end faces 51, 51' of said block 5. Said gaps are devoid of electrically conducting sealing material so as to electrically insulate said bars 6, 6' and said complementary bars 20, 20', 21, 21' from said block 5 in said areas 150, 150'. A connection end 61 of said first collector bars 6 protrudes through a first lateral wall 30 of said shell 3 for electrical connection thereto. A connection end 61' of said second collector bars 6' protrudes through a second lateral wall 30' of said shell 3 for electrical connection thereto. An inner end 62 of said first collector bars 6 and an inner end 62' of said second collector bars 6' are located within said groove 15 and are separated from one another by a gap 152 that is preferably filled with non-ceramic fibres.

Tests

Cathode assemblies similar to the one illustrated in FIG. 5 were made, inserted in an electrolysis cell and tested. The cell included 32 full-length collector bars. Two complementary bars were arranged and secured to each collector bar so that one complementary bar was located on each side of a central plane S. The collector bars were out of steel while the complementary bars were out of copper. The width Wc of the collector bars was equal to about 65 mm. The width W of the copper complementary bars was about 65 mm. The specified distances A and A' were about equal to 548 mm. The recess distances C and C' were about equal to 25 mm. The shift distances K and K' were about equal to 41 mm.

Cathode assemblies without copper bar were also made and tested for comparison (Tests Nos. 1 and 2). In all cases, the cathode block was made of carbonaceous material comprising 30 wt. % graphite. The current intensity of the cell was 76 kA in operation.

Table 1 discloses the height H of the collector bar, the thickness T of the copper bar, thickness G of carbonaceous material above the groove equal to about 197 mm, and the cathodic voltage drop Uc that was measured for each case.

TABLE 1

| Test | G (mm) | H (mm) | T (mm) | Uc (mV) |
|---|---|---|---|---|
| 1 | 197 | 115 | 0 | 450 |
| 2 | 172 | 140 | 0 | 400 |
| 3 | 197 | 80 | 35 | 280 |
| 4 | 197 | 100 | 16 | 325 |
| 5 | 197 | 30 | 20 | 300 |

The results show that an embodiment according to the invention displays cathodic voltage drops that are much smaller than that observed for arrangements with no copper. Furthermore, the cross-section of the collector bars can be significantly reduced and the total cross-section of the composite bar can be made much smaller than the cross-section of a corresponding single steel collector bar according to prior art while preserving relatively small cathodic voltage drops. It was further noticed that the thickness G could even be increased while maintaining cathodic voltage drop values much below the values of prior art.

It was further noted that the thickness G could be significantly increased while keeping the full thickness E of the block, thanks to the significant reduction of the dimensions of the collector bar made possible by the invention, without noticeably increasing of the cathodic voltage drop of the arrangement.

Cathode assemblies similar to the one illustrated in FIG. 8 were made, inserted in a similar electrolysis cell and tested. The parameters were: T equal to 35 mm; G equal to 197 mm; H equal to 115 mm and Wg equal to 50 mm and 100 mm. The measured cathodic voltage drops were about 300 mV and 330 mV, respectively.

| List of reference numerals | |
|---|---|
| 1 | Electrolytic cell |
| 2 | Pot |
| 3 | Shell |
| 4 | Refractory lining material |
| 5 | Carbonaceous cathode block |
| 6, 6' | Collector bar |
| 7 | External busbar conductor |
| 8 | Pad of liquid aluminium |
| 9 | Electrolytic bath |
| 10, 10' | Anodes |
| 11, 11' | Anode stems |
| 12, 12' | Anode beams |
| 13 | Protecting layer |
| 14 | Flexible aluminium fitting |
| 15, 15' | Grooves |
| 16, 16' | Solidified bath ridge |
| 20, 20', 21, 21' | Complementary bars |
| 22 | Transition plane |
| 23 | Supplementary bar |

-continued

| List of reference numerals | |
|---|---|
| 24 | Gap between complementary bar and supplementary bar |
| 30 | First lateral wall of a shell |
| 31 | Outer surface of first lateral wall |
| 32 | Inner surface of first lateral wall |
| 30' | Second lateral wall of a shell |
| 31' | Outer surface of second lateral wall |
| 32' | Inner surface of second lateral wall |
| 41, 41' | Side refractory lining |
| 50 | Cathode assembly |
| 51 | First end face of a cathode block |
| 51' | Second end face of a cathode block |
| 52, 52' | Side faces of a cathode block |
| 53 | Upper side face of a cathode block |
| 53' | Lower side face of a cathode block |
| 61 | First connection end of a collector bar |
| 61' | Second connection end of a collector bar |
| 62, 62' | Inner end of a collector bar |
| 63, 64 | Lateral side faces of a collector bar |
| 65 | Upper side face of a collector bar |
| 66 | Lower side face of a collector bar |
| 150, 150' | Electrically insulated areas |
| 151, 151' | Conducting sealing material |
| 152 | Gap between half-bars |
| 153, 154 | Lateral inner sides of groove |
| 155 | Bottom surface of groove |
| 201, 201', 211, 211' | First end of the complementary bars |
| 202, 202', 212, 212' | Second end of the complementary bars |

What is claimed is:

1. An electrolytic cell for production of aluminium, comprising:

a metallic shell comprising two lateral walls that are arranged substantially symmetrically with respect to a central plane;

at least one carbonaceous cathode block having side faces, end faces, and at least one groove, said block being arranged within said shell so that said groove is substantially perpendicular to said central plane;

at least one collector bar made of a first metal, having at least one connection end and side faces and arranged in said groove so that said at least one connection end projects out of said block through a specified end face thereof and out of the shell through a specified lateral wall thereof;

an external electrical circuit connected to the at least one connection end of said collector bar; and an electrically conducting sealing material within said groove to provide electrical contact between said collector bar and said block, wherein said cell further includes at least one complementary bar made of a second metal having an electrical conductivity greater than said first metal, wherein said at least one complementary bar has a first end and a second end, has a specified length, and is arranged adjacent to one of said side faces of said collector bar, wherein said second end is at a specified distance from said specified end face of said block, and wherein a supplementary bar made of a third metal is arranged on one of the side faces near said connection end of said collector bar so that there is a gap between said complementary bar and said supplementary bar, and wherein said third metal has an electrical conductivity greater than said first metal.

2. A cell according to claim 1, wherein said specified distance is between −150 mm and +600 mm.

3. A cell according to claim 1, wherein said second end is shifted from said at least one connection end by a shift distance greater than 100 mm.

4. A cell according to claim 3, wherein the cross-section of said complementary bar varies along said at least one complementary bar so as to impart thermal resistance to said at least one complementary bar towards said at least one connection end.

5. A cell according to claim 4, wherein said cross-section of said complementary varies in the vicinity of said second end.

6. A cell according to claim 4, wherein said cross-section of said complementary is smaller between a transition plane that is at an intermediate distance from said end face of said block and said second end of said complementary bar than between said first end of said complementary bar and said transition plane.

7. A cell according to claim 6, wherein said transition plane is inside said shell.

8. A cell according to claim 6, wherein said complementary bar has a first uniform cross-section between said first end and said transition plane and a second uniform cross-section between said transition plane and said second end.

9. A cell according to claim 6, wherein said complementary bar has a first uniform cross-section between said first end and said transition plane and a decreasing cross-section between said transition plane and said second end.

10. A cell according to claim 6, wherein said intermediate distance is between −200 mm and +300 mm.

11. A cell according to claim 1, wherein said collector bar and said complementary bar are electrically insulated from said block in at least one area extending between said specified end face of said block and a reference plane that is parallel to said central plane and is located at a lateral distance from said specified end face toward said central plane.

12. A cell according to claim 11, wherein said collector bar and said complementary bar are electrically insulated from said block in said at least one area by providing a gap between said collector bar and said block and between said complementary bar and said block in said area.

13. A cell according to claim 12, wherein said gap is devoid of electrically conducting sealing material.

14. A cell according to claim 1, wherein said first end of said complementary bar is located within said groove of said block.

15. A cell according to claim 1, wherein said first end of said complementary bar is located between said collector bar and said block.

16. A cell according to claim 1, wherein said complementary bar is adjacent to a side face of said collector bar facing a bottom surface of the groove.

17. A cell according to claim 1, wherein said complementary bar is adjacent to at least one of said side faces of said collector bar that face lateral inner sides of said groove.

18. A cell according to claim 1, wherein said third metal is the same as said second metal.

19. A cell according to claim 1, wherein conducting sealing material is interposed between said collector bar and said complementary bar.

20. A cell according to claim 19, wherein conducting sealing material surrounds a part of said complementary bar.

21. A cell according to claim 1, wherein the ratio of a transverse vertical cross-section of said complementary bar to a transverse vertical cross-section of said collector bar is greater than 5:100.

22. A cell according to claim 1, wherein the ratio of a transverse vertical cross-section of said complementary bar to a transverse vertical cross-section of said collector bar is greater than 25:100.

23. A cell according to claim 1, wherein said first end of said complementary bar is recessed from said central plane by a recess distance between 20 and 1300 mm.

24. A process of producing aluminium by igneous electrolysis, comprising: providing an electrolysis cell according to claim 1, said cell further comprising at least one anode, passing an electric current between said at least one anode and said carbonaceous cathode block, so as to produce aluminium by electrolytic reduction of alumina.

25. A cell according to claim 1, wherein a width of the gap is between 10 mm and 1000 mm.

26. A cell according to claim 1, wherein a width of the gap is between 20 mm and 200 mm.

* * * * *